US006865812B1

(12) United States Patent
Martin, Jr.

(10) Patent No.: US 6,865,812 B1
(45) Date of Patent: Mar. 15, 2005

(54) NAIL TRIMMER

(75) Inventor: Roy C. Martin, Jr., 97 French's Point, Glenburn, MA (US) 04401

(73) Assignee: Roy C. Martin, Jr., Glenburn, ME (US)

( * ) Notice: Subject to any disclaimer, the term of this patent is extended or adjusted under 35 U.S.C. 154(b) by 0 days.

(21) Appl. No.: 10/815,134

(22) Filed: Mar. 31, 2004

(51) Int. Cl.[7] ..... A45D 29/05
(52) U.S. Cl. ..... 30/27; 30/276
(58) Field of Search ..... 30/26, 276, 27

(56) References Cited

U.S. PATENT DOCUMENTS

| | | | | |
|---|---|---|---|---|
| 3,613,696 | A | | 10/1971 | Paule et al. |
| 3,780,780 | A | * | 12/1973 | Pettigrew et al. ..... 144/238 |
| 4,103,694 | A | | 8/1978 | Burian et al. |
| 4,117,591 | A | | 10/1978 | Terry |
| 4,175,573 | A | | 11/1979 | Burian |
| 4,292,987 | A | | 10/1981 | Alley |
| 4,328,819 | A | | 5/1982 | Haas |
| 4,408,623 | A | | 10/1983 | Murray |
| 4,440,182 | A | | 4/1984 | Holm |
| 4,643,207 | A | | 2/1987 | Grahame |
| 4,683,897 | A | | 8/1987 | McBride |
| 4,753,253 | A | | 6/1988 | Hutson |
| 4,776,090 | A | | 10/1988 | Grassi |
| 4,847,994 | A | | 7/1989 | Dunn, Jr. |
| 4,854,334 | A | | 8/1989 | Su |
| 4,893,406 | A | | 1/1990 | Larson |
| 4,956,915 | A | | 9/1990 | Anderson |
| 4,982,747 | A | | 1/1991 | Shaw |
| 5,033,485 | A | | 7/1991 | Hauerwas et al. |
| 5,074,041 | A | | 12/1991 | Wagner |
| 5,123,430 | A | * | 6/1992 | Davidovitz ..... 132/75.8 |
| 5,357,677 | A | | 10/1994 | West |
| 5,522,136 | A | | 6/1996 | Larisey |
| 5,546,658 | A | | 8/1996 | MacLeod et al. |
| 5,775,340 | A | | 7/1998 | Rains |
| 6,050,270 | A | | 4/2000 | Tyshenco, Jr. |
| 6,220,251 | B1 | | 4/2001 | Jeong et al. |
| 6,539,632 | B2 | | 4/2003 | Anctil |
| 6,601,587 | B2 | | 8/2003 | Shaw |
| 6,640,811 | B2 | | 11/2003 | Cho |

FOREIGN PATENT DOCUMENTS

| | | | | |
|---|---|---|---|---|
| CA | 670052 | * | 9/1963 | ..... 30/27 |
| CA | 2033913 | | 7/1991 | |
| CA | 2040117 | | 10/1992 | |
| DE | 3237597 | | 4/1984 | |
| DE | 3744425 | | 9/1989 | |
| DE | 10038445 | | 2/2002 | |
| EP | 0438968 | | 7/1991 | |
| EP | 0526386 | | 2/1993 | |
| FR | 2599965 | | 12/1987 | |
| IL | 93142 | | 4/1994 | |
| JP | 7047012 | | 2/1995 | |
| WO | WO03015566 | | 2/2003 | |

* cited by examiner

*Primary Examiner*—Douglas D Watts
(74) *Attorney, Agent, or Firm*—Bohan, Mathers & Associates, LLC; Patricia M. Mathers

(57) ABSTRACT

A nail trimmer for enabling a person to comfortably trim toenails without having to take on an awkward or uncomfortable posture. The nail trimmer has a long extension housing, which has a handle at its upper end and a trimmer unit at its lower end. A battery operated motor and on/off switch are incorporated into the handle end. A detachable trimmer unit is connected at the lower end. A dado cutting blade and a gear unit are enclosed in the trimmer unit. An opening in the trimmer unit housing provides access to the cutting edge of the blade.

1 Claim, 2 Drawing Sheets

NAIL TRIMMER

BACKGROUND INFORMATION

1. Field of the Invention

The invention relates to the field of trimmers for keratin. More particularly, the invention relates to a toenail/fingernail trimmer.

2. Description of the Prior Art

The conventional tool for trimming toenails or fingernails, that is, the keratin that constitutes the nail on a human, is a clipper with two pivoted levers that force cutting edges to close over and cut through the keratin. Trimming toenails with the conventional toenail trimmer is a difficult and uncomfortable task for the elderly, the obese, and the physically handicapped; for some, it is impossible. There are two major difficulties to performing the task of trimming one's own toenails. For one, the person must bend over to an uncomfortable and cramped position in order to reach the toenails with the conventional toenail trimmer. Even if one elevates the foot and bends the knee, the upper torso must still bend toward the foot. For obese or physically handicapped persons, taking on this bent posture may be painful, if not impossible. For another, the nail-cutting capability of the conventional toenail trimmer may be inadequate to cleanly cut through the keratin, which may become quite thick and tough. This is a common problem for the elderly, who may not have the manual strength to force the cutting edges of the conventional toenail clipper through the keratin.

In an effort to overcome the problem of lacking manual strength, a number of powered clippers or trimmers have been disclosed. These powered trimmers make it easier for the physically weak to cut through the nail material, but do nothing to eliminate the bent-over posture that may be so uncomfortable or even impossible for some persons to maintain for the time required to cut the nails. Most of these powered trimmers use an abrasive means, such as a wheel with a grit surface, to remove material. The disadvantage of this is that the abrasive grit is worn down with time, requiring replacement of the abrasive means of the the entire device. Furthermore, abrasive trimmers are invariably messy, as very fine bits of the removed keratin are flung out away from the wheel. Such abrasive trimmers also apply a pressure to the side of the nail, which is perceived as uncomfortable.

Some trimmers or clippers are provided with a baton-like extension bar. Without exception, these extension-bar trimmers are inconvenient or awkward to use because most are of cumbersome construction that permits none of the dexterity the user desires. Some extended trimmers have impractical arrangements of magnifying glasses and generally require good vision and careful concentration on the part of the user, as well as frequent cleaning.

None of the known clippers or trimmers is constructed such that it is unsafe for a person of normal vision and diligence to operate, but most such devices are difficult, if not downright dangerous, for a sight-handicapped person to use, as inadequate sight control of the device may easily result in cuts or bruises on the user and most certainly result in ineffective trimming.

What is needed, therefore, is a nail trimmer that is able to trim the keratin material of a toenail in a smooth, efficient, and comfortable manner. What is futher needed is such a nail trimmer that allows the user to maintain a comfortable posture, even when cutting toenails. What is yet further needed is such a nail trimmer that is so safe and easy to use, that even a sight-handicapped person can use it.

BRIEF SUMMARY OF THE INVENTION

For the reasons cited above, it is an object of the present invention to provide a nail trimmer that provides sufficient force to easily cut through keratin material of a toenail. It is a further object to provide such a nail trimmer that allows the user to maintain a comfortable posture when cutting toenails. It is a yet further object to provide such a nail trimmer that is safe and easy to use, even for a sight-handicapped person.

The objects of the invention are achieved by providing a motor-powered nail trimmer. The "nail" is the keratin layer on the toe or finger of a human. For purposes of simplicity, reference is made hereinafter to a "toenail;" it shall be understood, however, that the term toenail is used herein as a representative term that also includes a fingernail or an animal claw.

The nail trimmer according to the invention comprises a trimmer unit that includes a motor-driven rotatable cutting blade and that is detachably mounted at the end of an extension shaft. An extension housing encases a motor for driving the cutting blade and an ON/OFF switch, as well as the extension shaft. The housing has an upper end with a handle that is easy to grip. The ON/OFF switch is ideally located in the handle.

The trimmer unit includes a gear assembly that transmits the motor output to the cutting blade. To ensure that a person using the nail trimmer according to the invention does not inadvertently injure himself or herself, the cutting blade is enclosed in a blade housing that limits exposure of the cutting blade to a very slight depth. Thus, if a person were to place the nail trimmer up against the bottom or side of a toe, for example, the blade would not make a deep enough cut to break the skin.

Ideally, the cutting blade is a dado blade that removes a wide swath of keratin material relative to the width of the cutting blade. Although other types of cutting blades may be used in the nail trimmer according to the invention, the use of a dado blade is preferred over other types because the dado action provides a smooth trimming action and finished nail surface. A saw-toothed blade is preferred, as it provides a rapid rate of material removal, but a similarly sized and shaped carbide cutting/shaping wheel is also suitable for this application. Oscillating and rotating blades are described in some of the prior art, but none provide the ease and smoothness of use provided by a dado blade, famous in cabinet making for smooth and precise cutting unmatched by any other blade.

The motor is ideally mounted in the handle of the extension housing and powered by rechargeable battery unit, also housed in the handle. The output of the motor shaft is connected to the extension shaft that is enclosed within the extension housing. The trimmer unit snaps on to the end of the extension shaft, and by means of the gear assembly or a mechanical power converter, applies the power from the motor to the cutting blade. It is desirable that the nail trimmer according to the invention be as lightweight as possible and, for this reason, it is recommended that a lightweight, high-speed battery-operated motor be used. Such motors, such as the Dremmel 10 kilocycle motor, are well-known in the mechanical arts and are not described with greater detail herein.

As a safety means, the ON/OFF switch that controls the motor may be a gravity operated switch that switches the motor on only when the nail trimmer is held in a proper orientation, or a switch that requires that the user keep it depressed for continued operation, in other words, the switch switches automatically to the OFF position when the user lets go of it. Such safety switches provide assurance that the unit is operated only with intent and in the prescribed orientation for its intended function. Use of a gravity operated ON/OFF switch has the additional advantage in that it permits those with arthritic or other physical weakness in the hands to comfortably hold and easily use the nail trimmer, without having to apply pressure to the ON/OFF switch.

The exterior of the extension housing, especially that part that encloses the motor and serves as the handle, is ideally provided with a material or treatment that is pleasant to the touch, and facilitates a secure sense of gripping. The extension housing completely encloses the power and drive means for the cutting blade. The blade in the trimmer unit is almost completely enclosed by the trimmer unit housing. A small opening is provided in the trimmer unit housing to enable access to the cutting blade. The waste material is collected in the bottom of the trimmer unit, in a space provided beneath the cutting blade. A removable cap is fitted across the bottom of the trimmer unit. The cap serves a dual purpose. For one, it is easily removable from the trimmer unit, to allow disposal of the waste material collected within. The inside of the trimmer unit can be thoroughly washed out. For another, the cap serves as a guide and support for the toe with the toenail to be trimmed. To use the nail trimmer, the end of the trimmer unit with the cap is placed upon a floor or other surface, for example. The trimmer unit is moved into a cutting position by moving it up so close to the nail to be trimmed that the front edge of the cap, that is, the edge of the cap just below the blade opening, is positioned at the tip of the toe, just under the toenail. The cap has a contour that provides some support for the toe during the trimming operation and provides an important tactile sensation that allows a sight-impaired person to properly position the nail trimmer for use by feel alone. The cap also prevents injury in that it positions the toe properly in front of the blade, yet prevents the toe from moving in so close to the exposed cutting blade that it can be cut.

Although other configurations of the motor and trimmer unit are encompasses within the scope of the invention, the placement of the motor and battery in the upper end of the extension housing provides a device that is so balanced, that the user is able to precisely control the position of the trimmer unit simply with pressure applied by the fingertips that grip the handle. The overall length of the nail trimmer is selected to allow a seated person to comfortably trim his or her toenails, without having to take on a cramped position. Ideally, the length of the extension housing is approximately 18 inches, although the extension housing may be provided in various lengths to accommodate users who are extremely tall or extremely short.

The nail trimmer according to the invention provides a lightweight, maneuverable, and convenient tool for comfortable, even pleasurable trimming of finger and toenails, for the obese, the physically challenged, the elderly, and the sight-handicapped persons.

DETAILED DESCRIPTION OF THE INVENTION

Figure 1:
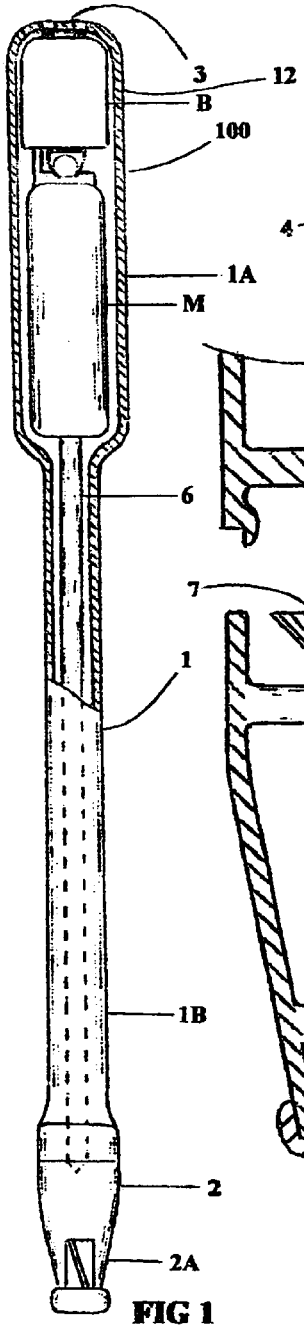
FIG. 1 is an illustration of a nail trimmer according to the invention.

FIG. 1 illustrates a nail trimmer 100 according to the invention. It is intended to be a baton-like instrument of a length to enable a sitting person to easily operate the device on the toenails in that position. The nail trimmer 100 comprises two parts; an extension housing 1 and a trimmer unit 2 that includes a rotating cutting blade 8 for trimming keratin. The extension housing 1 houses a motor M for driving the cutting blade 8, a battery B for powering the motor, and an on/off switch S. Preferably, the motor M is a light high-speed, rechargeable battery-operated motor and the battery B is a rechargeable battery. In the embodiment shown, recharge contacts 3 are provided at the very top of the extension housing 1. The on/off switch S controls operation of the motor M.

The extension housing 1 has an upper end 1A and a lower end 1B. The trimmer unit 2 is detachably assembled at the end of the extension housing 1. The upper end 1A is formed as a handle to facilitate gripping of the nail trimmer 100 and is preferably covered with a soft and slip-free exterior that is pleasant to the touch and enhances the user's grip. The length of the extension housing 1 is such that the user is able to grip the upper end or handle 1A and to position the trimmer unit 2 near the toes, without having to take on an uncomfortable posture. For the average person, the ideal length of the extension housing 1 is approximately 18 inches.

With continued reference to FIG. 1, the motor M is enclosed in the handle 1A of the extension housing 1. Extending down through the extension housing 1 from the motor output is an output shaft 6. The trimmer unit 2 is attached to the lower end of the extension housing 1. Placement of the motor M and the battery B in the upper end 1A of the extension housing 1 has the advantage that it provides a good balance to the trimmer unit 2 at the lower end 1B of the housing 1 and improves maneuverability of the nail trimmer 100, easily enabling the user to control precise placement of the trimmer unit 2 at the selected site, with deftness and dexterity by applying pressure with the tips of the one's fingers. Also shown in FIG. 1 is a covering 12 of a fabric or material that is pleasant to the touch. Examples of suitable materials for the covering 12 include rubber or rubber-like materials, leather, woven and non-woven fabrics, fabrics with a padded undersurface, etc.

Figure 2:
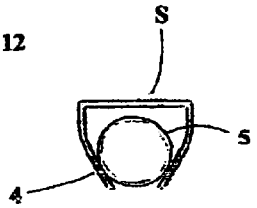
FIG. 2 represents a suggested shape of a cross-section of a cylindrically formed on/off switch.

FIG. 2 illustrates a cylindrically formed conventional on/off switch S, which, in this embodiment, is a gravity-feed switch with an electrically conductive ball 5 which, when the nail trimmer 100 is held in the upright position, makes contact with electrical contacts 4 provided in the sloping sides of switch S and energizes the motor circuit. Switch S and ball 5 may be quite small and fit in any available space within the motor M portion of the extension housing 1. Ideally, the ball 5 is heavy enough to ensure reliable contact with the contacts 4 while nail trimmer 100 is held in the position intended for use. As mentioned above, recharge contacts are provided at the very top of the upper end 1A of the extension housing 1. Thus, the nail trimmer 100 when stored upside down, for example, in a charging stand, is switched off, and when turned upright, is automatically switched on. This ON/OFF switch is by way of illustration only. There are many types of ON/OFF switches that would be suitable for use with the nail trimmer. Alternatively, a safety lock may also be provided that, when in the lock position, prevents the gravity feed ON/OFF switch from energizing the motor M, even when the nail trimmer 100 is turned upright to its operating position.

Figure 3:
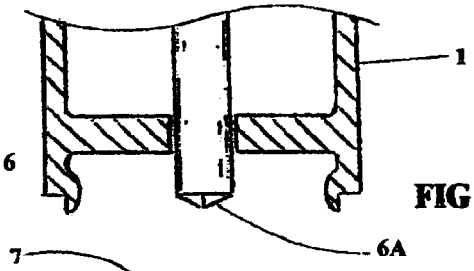
FIG. 3 presents an illustration of the keyed end part of the motor's impeller rod, which ultimately provides the force for driving a dado blade.
Figure 4:
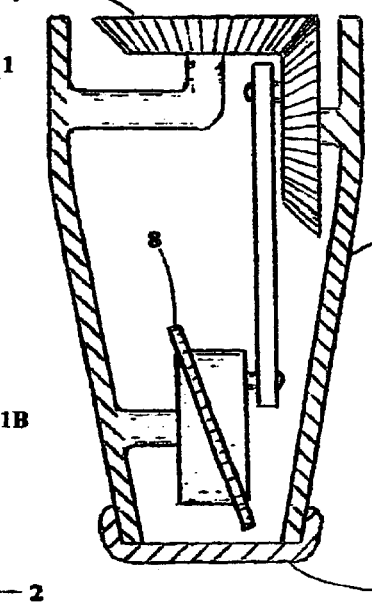
FIG. 4 depicts the suggested driving mechanism housed in the detachable trimmer unit of the invention as viewed from the toe position.
Figure 5:
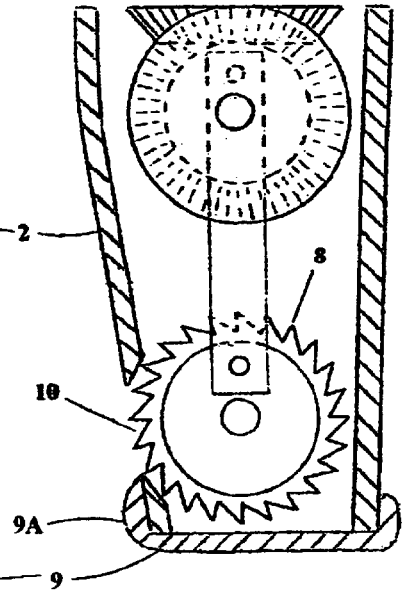
FIG. 5 presents a view 90° from that of FIG. 4, and shows how the blade nestles up to the opening in the extension housing to permit efficient and safe contact with the nail.

FIGS. 3–5 illustrate the trimmer unit 2 and its connection to the output shaft 6. The motor 2 turns the output shaft 6, which drives the cutting blade 8. FIG. 3 shows that the output shaft 6 extends to the lower end 1B of the extension housing 1. The power from the motor M is transmitted to the trimmer unit 2 by means of a key on the lower end 6A of the output shaft 6 and a mating recess on a drive mechanism 7 in the trimmer unit 2. The keyed shape of the lower end 6A is shown in FIG. 3. The mating recess on the trimmer unit 2 is not shown, but this type of power transmission is well-known and understoond in the mechanical arts.

FIGS. 4 and 5 present cross-sectional views of the trimmer unit 2; FIG. 4 as viewed from the user's toe position and FIG. 5 as viewed 90-degrees offset from FIG. 4. The trimmer unit 2 comprises a housing 2A, the drive mechanism 7, the cutting blade 8, and a removable cap 9. The trimmer unit 2 is detachably connected to the lower end 1B of the extension housing 1. There are many attachment mechanisms that are suitable here, such as a friction fit or a snap mechanism between the extension housing 1 and the trimmer unit 2, or some other mechanism that allows the trimmer unit 2 to be easily snapped on or off by the user for cleaning. The drive mechanism 7 is a pair of bevel gears that transmits the rotating motion of the output shaft 6 to a drive bar that fixedly connects the drive mechanism 7 to the cutting blade 8. In the embodiment shown, the cutting blade 8 is a dado blade. For the particular application in the trimmer unit 2, the dado blade is ideally about ¾" in diameter and trims a width of about ¼". An opening 10 is provided in the trimmer unit 2, exposing the cutting edge of the cutting blade 8. The overall width of the trimmer unit 2 is preferably no greater than 1 inch, and the desired overall vertical length is desired to be no greater than 2 inches.

The removable cap 9 is connected to the trimmer unit 2 by friction fit, and is easily pulled on or off by the user for cleaning the trimmer unit 2 of waste material. The cap 9 is preferably made of a rubber or rubber-like material. The rubber material provides a secure anti-skid support for the nail trimmer 100 when it is placed on a floor for operation and is also a very suitable material for supporting the toe during a trimming session.

Figure 6:
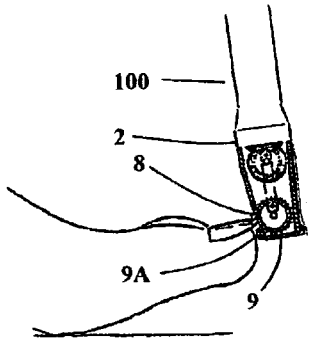
FIG. 6 illustrates use of the nail trimmer, with the cap positioned under the toe.
Figure 7:
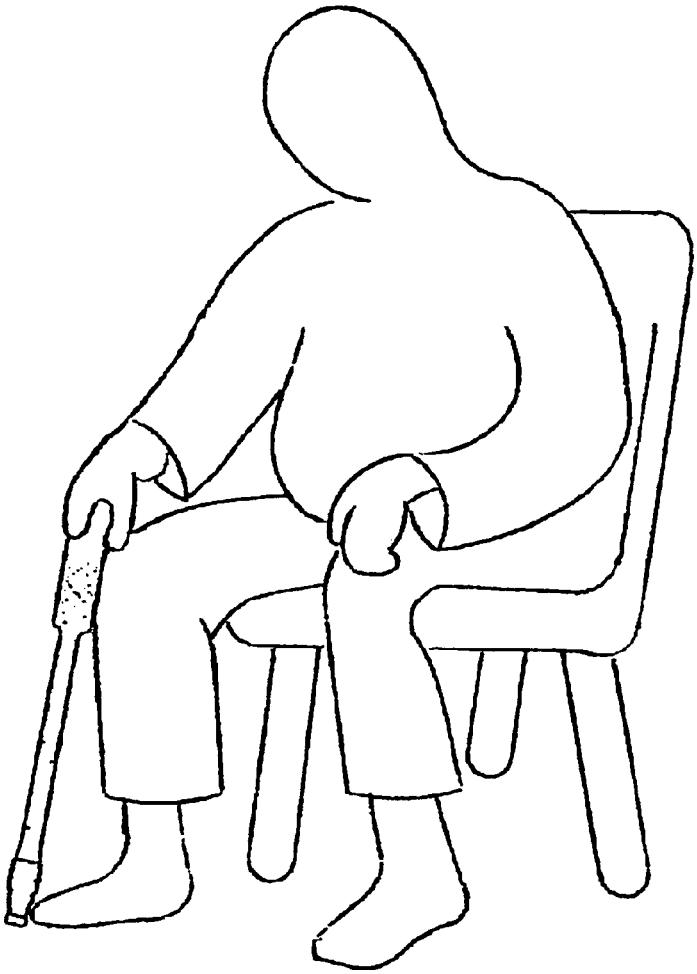
FIG. 7 illustrates use of the nail trimmer according to the invention.

FIGS. 6 and 7 illustrate use of the nail trimmer 100. FIG. 6 shows in detail the position of the toe with the nail to be trimmed relative to trimmer unit 2. As shown, the cap 9 has a front edge 9A against which the front portion of the toe rests. Used in this manner, the cutting blade 8 trims the toenail, yet is prevented from injuring the toe. It is important that the material used for the cap have qualities that allow it to provide a secure support for the trimmer unit 2 and that feel pleasant against the skin. Preferably, the cap 9 has anti-skid qualifies that prevent the nail trimmer 100 from slipping from its desired position. In the embodiment described, the material used for the cap is rubber, although the scope of the invention includes other suitable materials, such as synthetic or natural materials that provide the desired qualities. FIG. 7 shows a seated user positioning the nail trimmer 100 for use.

It is understood that the nail trimmer 100 according to the invention may be used for other applications, such as trimming the claws of animals, and the dimensions given above are in no way limiting. For example, it may be desirable to construct the nail trimmer 100 as a device with much greater or smaller dimensions than the dimensions given for the nail trimmer 100.

It is understood that the embodiments described herein are merely illustrative of the present invention. Variations in the construction of the nail trimmer may be contemplated by one skilled in the art without limiting the intended scope of the invention herein disclosed and as defined by the following claims. It is understood that the phraseology and terminology employed herein are for the purpose of description and are not limiting. The nail trimmer according to the invention may be applicable to other uses, and the claims of this invention should not be considered as limiting to only its stated intention.

What is claimed is:

1. A nail trimmer comprising:

an automatically operated dado blade mounted in an extended baton-like device which is of a length that assures the user of a comfortable and convenient functioning;

the longer of the two baton-like device parts containing a high-speed DC motor, which, through a mechanical connection drives a dado blade in the shorter of the two parts of the baton-like device, such that the functioning edge of the dado blade rotates only down on the nail being trimmed;

the said high-speed motor DC motor being controlled by a gravity-operated switch which permits dado blade operation only in approximation of the functioning attitude of the baton-like device;

and, the shorter of the two parts of the baton-like device houses the dado blade trimmer such that the blade is mounted transversally, permitting the functioning edge of the blade to rotate down across a narrow opening in the side of said housing;

the size and shape of said narrow opening in the housing is such that only a safe exposure to the cutting edge of the dado blade is assured;

the said housing of the shorter of the two parts of the baton-like device being of a shape and size that permits a facile movement around and between the user's toes, and which supports a specially shaped removable rubber like cover which provides the toe with assured safe positioning, and when removed, an efficient clean out opening.

* * * * *